US005833437A

United States Patent [19]

Kurth et al.

[11] Patent Number: 5,833,437

[45] Date of Patent: Nov. 10, 1998

[54] BILGE PUMP

[75] Inventors: Brian J. Kurth, Lake Elsinore; Charles W. Manahan, Anaheim; Anil B. Patel, La Crescenta; Kenneth Peterson, Corona, all of Calif.

[73] Assignee: Shurflo Pump Manufacturing Co., Santa Ana, Calif.

[21] Appl. No.: 674,428

[22] Filed: Jul. 2, 1996

[51] Int. Cl.[6] ..... F04B 49/00; F04B 17/00

[52] U.S. Cl. ..... 417/36; 417/44.11; 417/366; 417/369; 417/423.3; 417/423.7; 417/423.8; 417/423.9; 417/423.15; 417/423.14; 417/372; 415/220

[58] Field of Search ..... 417/18, 36–40, 417/44.1, 45, 44.11, 349, 352, 357, 366, 369–372, 420, 423.14, 423.15, 423.3, 423.7, 423.8, 423.9; 415/146, 219, 220

[56] References Cited

U.S. PATENT DOCUMENTS

| | | | |
|---|---|---|---|
| 1,609,915 | 12/1926 | Parker . | |
| 2,219,359 | 9/1940 | Goit et al. . | |
| 2,824,520 | 2/1958 | Bartels | 417/423.7 |
| 2,920,574 | 1/1960 | Sampietro | 417/423.7 |
| 2,996,994 | 6/1961 | Wright . | |
| 3,316,845 | 5/1967 | Schumann . | |
| 3,411,450 | 11/1968 | Clifton . | |
| 3,464,358 | 9/1969 | Lind . | |
| 3,465,681 | 9/1969 | Zimmermann . | |
| 3,545,892 | 12/1970 | Zimmermann . | |
| 3,717,420 | 2/1973 | Rachocki . | |
| 3,748,066 | 7/1973 | Sully et al. | 417/424 |
| 3,850,550 | 11/1974 | Kaessen | 417/372 |
| 3,861,831 | 1/1975 | Rule | 417/423.14 |
| 3,941,507 | 3/1976 | Niedermeyer . | |
| 4,013,384 | 3/1977 | Oikawa . | |
| 4,047,847 | 9/1977 | Oikawa . | |
| 4,171,932 | 10/1979 | Miller . | |
| 4,213,745 | 7/1980 | Roberts | 417/363 |
| 4,275,995 | 6/1981 | Taylor | 417/36 |
| 4,371,316 | 2/1983 | Ivic . | |
| 4,518,316 | 5/1985 | Yokota . | |
| 4,525,125 | 6/1985 | Matsumoto et al. . | |
| 4,596,514 | 6/1986 | Matsumoto et al. . | |
| 4,645,426 | 2/1987 | Hartley et al. | 417/38 |
| 4,678,403 | 7/1987 | Rudy et al. . | |
| 4,766,329 | 8/1988 | Santiago . | |
| 4,863,355 | 9/1989 | Odagiri et al. . | |
| 4,881,873 | 11/1989 | Smith et al. . | |
| 4,943,210 | 7/1990 | Bailey, Jr. et al. | 417/40 |
| 4,972,709 | 11/1990 | Bailey, Jr. et al. | 417/40 |

(List continued on next page.)

FOREIGN PATENT DOCUMENTS

| | | | |
|---|---|---|---|
| 328075 | 8/1989 | European Pat. Off. . | |
| 955857 | 1/1950 | France . | |
| 1204020 | 1/1960 | France | 417/423.14 |
| 1535864 | 8/1968 | France . | |
| 7013106 | 12/1971 | France . | |
| 2410154 | 6/1979 | France . | |
| 1129055 | 6/1956 | Germany . | |
| 2308369 | 8/1974 | Germany . | |
| 2743112 | 4/1979 | Germany . | |
| 3824847 | 1/1990 | Germany . | |
| 4110488 | 11/1991 | Germany . | |
| 4244417 | 7/1994 | Germany . | |
| 895256 | 5/1962 | United Kingdom . | |

*Primary Examiner*—Meng-Ai T. An
*Assistant Examiner*—Xuan M. Thai
*Attorney, Agent, or Firm*—Frank J. Uxa

[57] ABSTRACT

Pumps, for example, bilge pumps, comprise a pump housing including an inlet and an outlet, a motor and an impeller assembly coupled to the motor for pumping liquid which passes through the outlet. The motor is advantageously cooled by pumped liquid while being protected from the pumped liquid. Further, the motor is turned on and off in response to actual operating conditions, thereby increasing pump life and reducing overall power consumption. The pump provides contoured facing surfaces which provide a dynamically efficient flow path for the pumped liquid. In addition, a switch housing is preferably provided to allow liquid to contact an activator assembly which turns the motor on.

21 Claims, 5 Drawing Sheets

U.S. PATENT DOCUMENTS

| | | | |
|---|---|---|---|
| 5,064,347 | 11/1991 | Lavalley, Sr. . | |
| 5,076,763 | 12/1991 | Anastos et al. | 417/44 |
| 5,263,825 | 11/1993 | Doolin | 417/63 |
| 5,297,939 | 3/1994 | Orth et al. | 417/40 |
| 5,322,421 | 6/1994 | Hansen . | |
| 5,324,170 | 6/1994 | Anastos et al. . | |
| 5,324,171 | 6/1994 | Cook . | |
| 5,336,052 | 8/1994 | Zollner et al. . | |
| 5,340,282 | 8/1994 | Milocco . | |
| 5,365,220 | 11/1994 | Rasmason . | |
| 5,404,048 | 4/1995 | Panner . | |
| 5,425,624 | 6/1995 | Williams | 417/36 |
| 5,545,012 | 8/1996 | Anastos et al. | 417/44.11 |
| 5,549,456 | 8/1996 | Burrill et al. | 417/44.11 |
| 5,586,862 | 12/1996 | Danner | 417/315 |

BILGE PUMP

BACKGROUND OF THE INVENTION

This invention relates to pumps for pumping bilge liquids, salt water and the like. More particularly, the invention is directed to such pumps which are highly efficient, and are effectively and easily cooled and controlled.

Bilge pumps are employed to remove water and other liquids from boats. A number of bilge pumps have been suggested by the prior art. The bilge liquid is often contaminated by solid liquid and/or solid materials which can harm or interfere with the operation of the pump and/or control system. This is particularly important for bilge pumps since such pumps are expected to operate over long periods of time with little or no maintenance, and must be reliable even after long periods of inactivity. In addition, bilge pumps should be effectively cooled to provide optimal results. Also, the on-off cycling of a bilge pump can adversely affect the power consumption and effective life of the pump. Thus, controlling the on-off status is an important aspect of bilge pump operation.

There continues to be a need to provide pumps, such as bilge pumps, with high efficiency and effectiveness, good control characteristics, long life and reduced maintenance requirements.

SUMMARY OF THE INVENTION

New liquid pumping pumps, such as pumps for pumping bilge liquids, salt water and the like, have been discovered. The present pumps take advantage of the relatively reduced temperature of the liquid, for example, bilge liquid, that is being pumped to cool the pump motor. Such cooling effectively and straightforwardly cools the motor so that very efficient pump operation is achieved. In addition, although the bilge liquid comes in contact with the motor housing, the motor is very effectively protected against direct exposure to the liquid.

Another feature of the invention provides for complementing configurations for or contouring of the pump housing, the motor housing and the impeller assembly of the pump so as to provide a very effective and dynamic flow path or passageway for the liquid being pumped. This enhances pump efficiency. In addition, the pump housing preferably includes gas expulsion ribs or vanes which more preferably are configured or contoured to be complementary to the shape of the facing motor housing. Such contouring of the vanes enhances pump efficiency and reduces power consumption.

In yet another feature of the invention, the pump is provided with an activator assembly which is effective in activating the motor in response to liquid being at a certain level, for example, outside the pump housing. A cover is provided which acts to allow liquid to come in contact with a portion of the activator assembly to provide the required activation signal. At the same time, the cover effectively inhibits solid debris from interfering with the liquid contacting the activator assembly.

One additional feature provides that the pump has an electric motor and that a current sensing assembly is included to sense the amount of electric current used to operate the electric motor. The current sensing assembly is effective in deactivating or turning off the electric motor when the amount of electric current used is less than a defined amount.

These last two features provide a very effective and reliable control system for turning the pump on and off. In both instances, the pump is turned on or off because of a specific operating condition rather than, for example, at regular time intervals. Turning the pump on and off when required by actual operating conditions advantageously enhances the effectiveness and efficiency of the pump, increases pump life and reduces overall power consumption.

In one broad aspect of the present invention the present pumps comprise a pump housing, preferably having opposing first and second end regions and defining a chamber; an inlet in the pump housing, preferably at the first end region; an outlet in the pump housing, preferably at said second end region; a motor; and an impeller assembly operatively coupled to the motor for pumping liquid which passes through the inlet.

A motor housing is preferably included and extends into the chamber defined by the pump housing. In one useful embodiment, the pump housing, motor housing and impeller assembly, together form a liquid passageway from the inlet to the outlet. The liquid passageway preferably extends along at least a substantial portion of the length of the motor housing within the chamber defined by the pump housing. The outlet, for example, at the second end region, is preferably oriented relative to the liquid passageway so that the liquid passes through the outlet substantially tangentially relative to the longitudinal axis of the pump housing. A major portion of the liquid passageway is preferably defined by the inner surface of the pump housing and the outer surface of the motor housing. The liquid passageway may be, and preferably is, in the form of an annular space between the pump housing and the motor housing.

The liquid passageway is preferably configured so that liquid in the liquid passageway cools the motor as the liquid moves from the inlet to the outlet. This cooling is very effective and straightforward, requiring no extraneous or additional coolant or additional equipment.

In another very useful embodiment, the motor housing has a curved or contoured outer surface facing a curved or contoured inner surface of the pump housing. In this context, the terms "curved" or "contoured" mean that the inner surface of the pump housing and the outer surface of the motor housing are other than straight lines when viewed in cross-section in a plane including the longitudinal axis of the pump housing. These facing curved surfaces are preferably located closer to the inlet than to the outlet of the pump, for example, in the region of the transition between the bottom and side of the pump housing. The curved inner surface of the pump housing and the curved outer surface of the motor housing together form a portion of the liquid passageway and are curved to substantially complement each other. Such complementary curving or contouring of these two surfaces very effectively, and relatively simply, provides an effective dynamic path for the pumped liquid to pass from the inlet to the outlet of the pump. This dynamic pathway enhances the efficiency of the pump, reduces power consumption and reduces unwanted and energy consuming liquid back mixing in the pump.

The pump housing includes a plurality of ribs extending inwardly from the inner surface of the pump housing. These ribs are effective in expelling the gas that may be located in the pump during start up, after an inactive period, of the pump. More preferably, these ribs are curved so as to substantially complement the curved portion of the outer surface of the motor housing. This facilitates providing a dynamic flow path for the liquid being pumped. Thus, the ribs, curved as noted above, not only provide for effective gas expulsion, which enhances pump efficiency, but also facilitate the passage of the pumped liquid through the pump, thereby further enhancing the efficiency of the pump.

In another aspect of the invention, an activator assembly is provided which is operatively coupled to the motor and is adapted to activate the motor in response to liquid, for example, around the outside of the pump housing, being at a defined level. This activator assembly may include a float device, an electric conductivity probe assembly and the like. A number of such activator assemblies are conventional and well known in the art.

A cover is preferably provided that together with the pump housing, surrounds the portion of the activator assembly which comes in contact with liquid. This cover includes a region having a plurality of elongated through openings to allow liquid from outside the cover to come in contact with this portion of the activator assembly. This region is contoured inwardly toward the pump housing to inhibit debris in the liquid outside the cover from blocking the elongated through openings. Thus, the liquid can pass through the elongated through openings and contact the activator assembly thereby providing a clear indication that sufficient liquid is present so that the motor should be activated. This is an important aspect of the invention in that bilge liquid often is contaminated with debris which can block the passage of liquid to the activator assembly. By providing that the cover is configured to inhibit this debris from sticking to the cover, the elongated openings are effective to provide flow passage for the liquid to come in contact with the activator assembly so as to activate the motor, as needed.

In yet another aspect of the invention, a current sensing assembly is provided in embodiments which include an electric motor. The current sensing assembly is operatively coupled to the electric motor and senses the amount of current used to operate the electric motor and to deactivate the electric motor when the amount of electric current used to operate the electric motor is less than a defined amount. This is a very effective way of turning the motor off. Without any liquid to pump, the load on the impeller assembly, and consequently on the motor, is greatly reduced. This results in less current being required to operate the motor. When the current sensing assembly senses this reduced amount of current, the motor is deactivated or turned off. Again, a very specific operating condition, that is no liquid being present to be pumped, causes the motor to be turned off. When the current sensing assembly is used in combination with the activator assembly which turns the motor on when sufficient liquid is present to be pumped, a very effective and efficient on-off switching system is provided. Again, the motor is turned on when liquid is available and is turned off when liquid is not available.

Unless two or more features of the present pumps are mutually inconsistent, pumps including any one or more of the features described herein may be used and are included within the scope of the present invention.

These and other aspects of the present invention will become apparent in the following detailed description, particularly in conjunction with the accompanying drawings in which like parts bear like reference numerals.

DETAILED DESCRIPTION OF THE DRAWINGS

Figure 1:
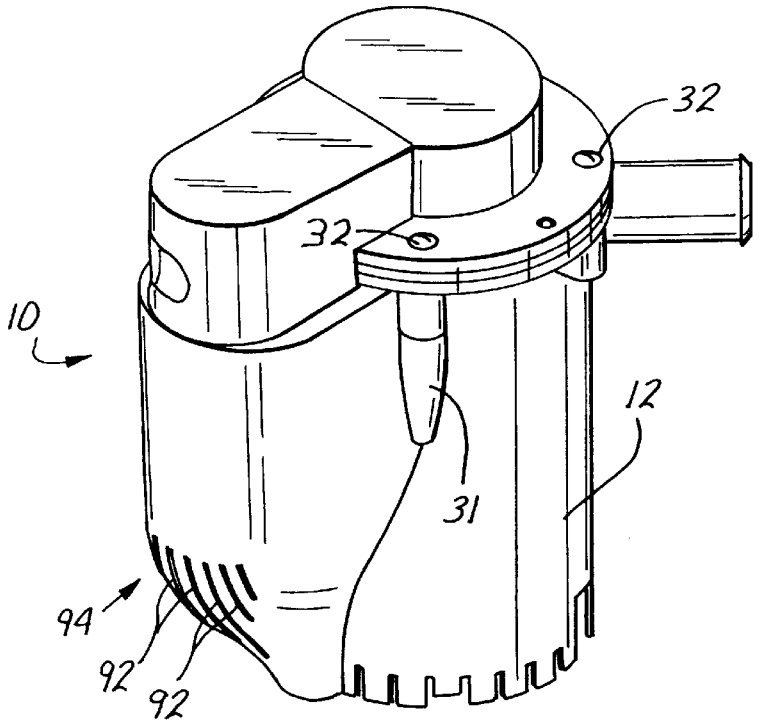
FIG. 1 is a front side view, in perspective, of one embodiment of the bilge pump in accordance with the present invention.

The bilge pump illustrated in FIGS. 1, 2, 3 and 5, shown generally at 10, includes a pump housing 12, a connector housing 14, a lower motor housing or separator 16, an upper or main motor housing 18, an electric motor 20, a magnetic coupling 22, an impeller 24 which includes downwardly extending impeller blades 26, and a cover or switch housing 30.

Figure 2:
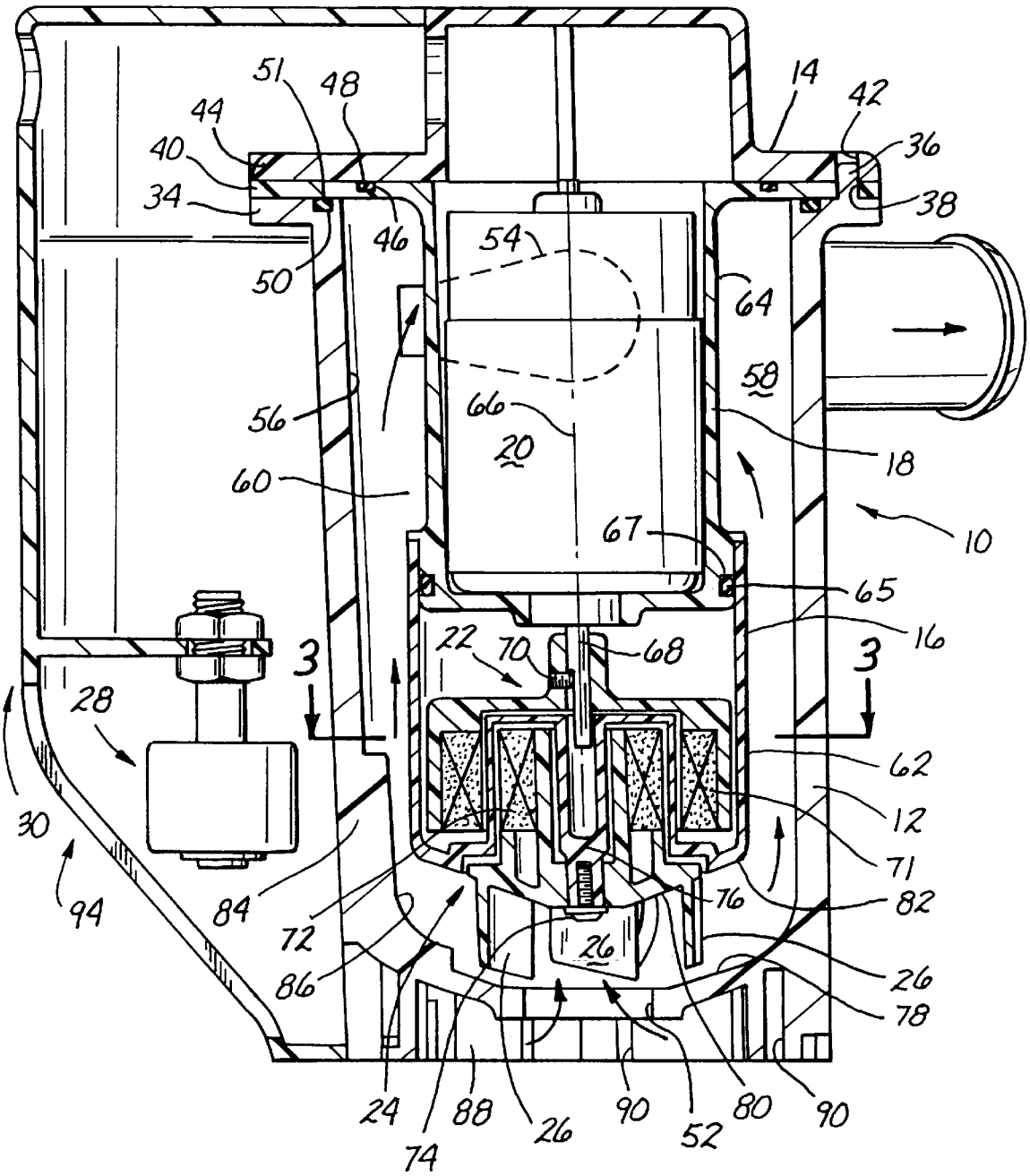
FIG. 2 is a cross-sectional view of the bilge pump shown in FIG. 1.

Screw-type fasteners 32 (4 in number) are employed to join pump housing 12 to main motor housing 18 and connector housing 14. In order to provide for proper alignment between these housing parts a series of mating pegs and recesses are provided. Thus, the radially extending flange 34 of pump housing 12 includes two pegs 36 (one shown) each of which is adapted to be received in opening 38 which extends through flange 40 of motor housing 18 and opening 42 which extends through flange 44 of connector housing 14. In this manner, these housing parts are brought into proper registration to be fastened together. Flange 40 includes an annular groove 46 adapted to receive an O-ring 48, while flange 34 includes an annular groove 50 adapted to receive an O-ring 51. These O-rings 48 and 51 provide effective fluid tight seals when the housing parts are fastened together, for example, as shown in FIG. 2.

Pump housing 12 includes an inlet opening 52 and an outlet opening 54, and includes an inner sidewall 56 which defines a chamber 58. A liquid passageway 60 is located within chamber 58, extends from inlet opening 52 to outlet opening 54 and is defined by inner wall 56 of pump housing 12, impeller 24, outer wall 62 of separator 16 and outer wall 64 of main motor housing 18. Liquid passageway 60 defines a passageway for liquid to pass from inlet opening 52 to outlet opening 54. As can best be seen in FIGS. 2 and 3, a major portion, that is at least about 50% of liquid passageway 60 is an annular space between the pump housing 12 and the separator 16 and main motor housing 18. As the liquid which is pumped by the action of impeller blades 26 passes in the liquid passageway 60 from inlet opening 52 to outlet opening 54, the liquid comes in contact with a substantial portion of the outer surface 64 of main motor housing 18. Since this pumped liquid is ordinarily at a relatively low or reduced temperature, the contacting of the liquid with the motor housing effects cooling of the electric motor 20. This cooling is accomplished very easily and straightforwardly, without extraneous coolants or equipment.

In addition, outlet opening 54 is situated so that the pumped liquid in liquid passageway 60 leaves or exits liquid passageway 60 substantially tangentially to the longitudinal axis 66 of the pump housing 12. This provides reduced resistance to the pumped fluid leaving the liquid passageway 60 and enhances pump efficiency.

Main motor housing 18 is secured to separator 16 by an interference or friction fit. An O-ring seal 65 is placed in an annular opening 67 in main motor housing 18. O-ring 65 effectively seals the motor 20 and magnetic coupling 22 from the bilge liquid passing through liquid passageway 60.

It is important that during operation of the pump, the main housing 18, separator 16 and O-ring seal 65 all are stationary. The stationary or static condition of these components effectively increases the life of pump 10, relative to pumps with seals and motor housings which rotate or otherwise move during pump operation, while effectively preventing bilge liquid from contacting the motor 20 or the magnetic coupling 22.

The electric motor 20, of conventional design, is placed inside the main motor housing 18, with the motor shaft 68 depending therefrom. The magnetic coupling 22 is secured to shaft 68 by means of a set screw 70. Magnetic coupling 22 includes a drive magnet 71 which extends around impeller 24. A smaller driven magnet 72 is secured to impeller 24 and is located radially inwardly of drive magnet 71. Drive and driven magnets 71 and 72, respectively, are situated and configured so that as motor 20 is operated to rotate shaft 68, magnet coupling 22 also rotates and, because of the magnetic forces involved, causes impeller 24 to rotate. Rotating impeller 24 causes impeller blades 26 to provide a pumping action to the liquid entering through inlet opening 52. In this manner, the liquid entering through inlet opening 52 is pumped to the outlet opening 54 through the liquid passageway 60.

Impeller 24 is held in place by a screw/washer combination 74 which is secured to the downwardly extending central portion 76 of separator 16 and extends outwardly to hold impeller 24 in place, that is to prevent impeller 24 from falling from magnet coupling 22.

The portion of the liquid passageway 60 near the inlet opening 52 is configured to provide a dynamic flow path for the pumped liquid. In particular, the lower portion of the inner sidewall of pump housing 12, designated as 78, is contoured to substantially complement the contouring or curving of the facing wall 80 of impeller 24 and facing wall 82 of separator 16. As used herein, the terms "complement" or "complementing" refer to the curving or contouring of facing surfaces in which the degree or extent of curving or contouring of each of the facing surfaces is substantially the same. The complementing contouring or curving of these facing surfaces very effectively provides a smooth or dynamically efficient flow path for the pumped liquid to pass from the inlet opening 52 into the liquid passageway 60 to the outlet opening 54. Such contouring or curving reduces overall power consumption and enhances pump efficiency, for example, relative to a substantially identical pump in which one or both of the facing surfaces is straight and/or forms a squared off (about 90°) corner (when viewed in cross-section in a plane including the longitudinal axis of the lower pump housing).

In addition, the portion of pump housing 12 with transitions between the bottom and the side of this component includes a series of three (3) ribs 84. These ribs 84 effectively allow for the expelling of gases that may be located in the fluid passageway 60, for example, because of periods of pump inactivity. The ribs 84 include a surface 86 which faces the surfaces 80 and 82 of impeller 24 and separator 16, respectively. The surface 86 of each of the ribs 84 is curved or contoured to substantially complement the curving of the surfaces 80 and 82. Such complementing curving or contouring facilitates the passage of the pumped liquid through the liquid passageway 60. Thus, the ribs 84 are effective not only to facilitate expulsion of gases which may be located in liquid passageway 60, but also, because of the complementing contouring or curving, also facilitate the passage of liquid in the liquid passageway.

Figure 3:
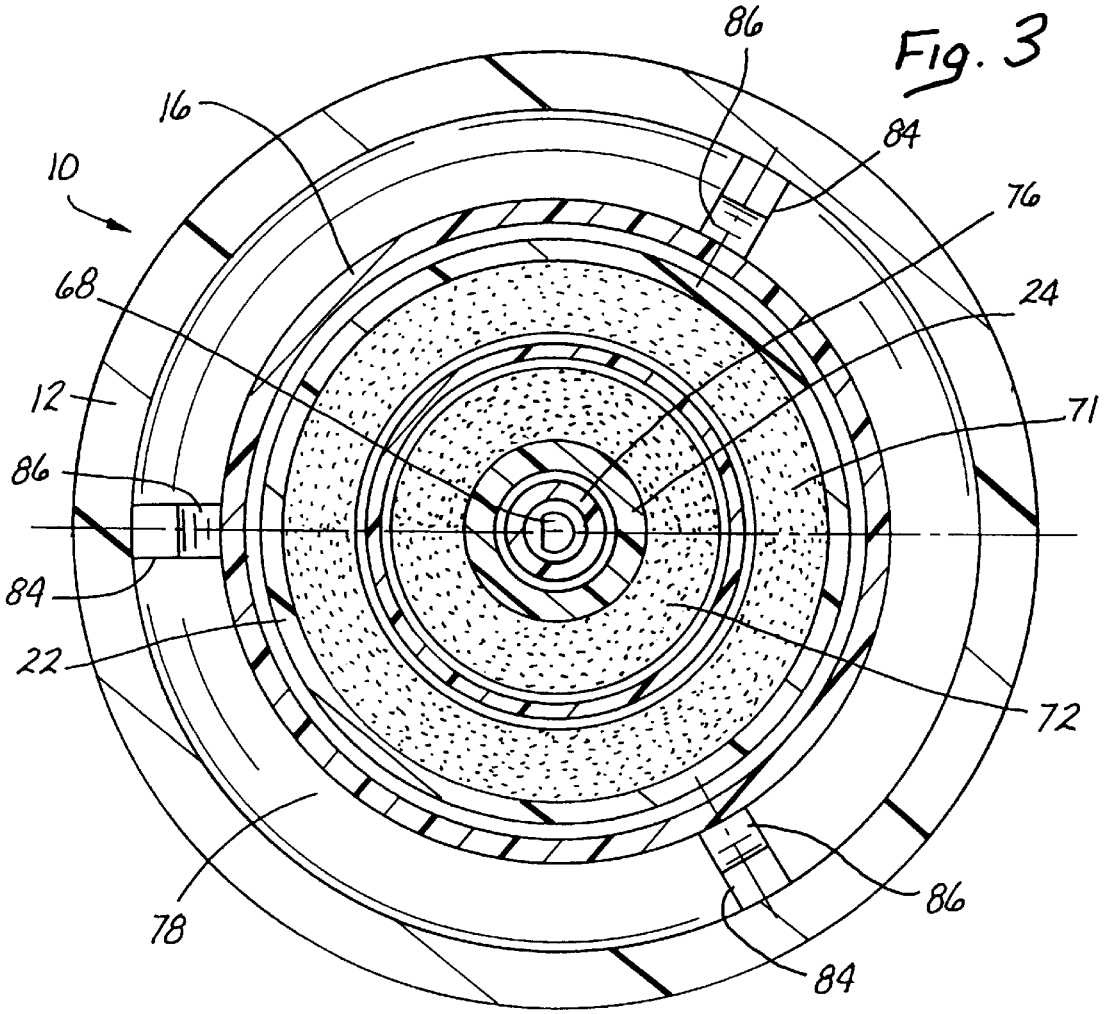
FIG. 3 is a cross-sectional view taken along line 3—3 of FIG. 2.

In the embodiment shown in FIGS. 1, 2 and 3, the lower portion of pump housing 12 includes a base 88 including a series of laterally extending openings 90 which are located around the base. These openings 90 are configured so that bilge liquid can flow through the openings 90 into the inlet opening 52. The openings 90 are configured to inhibit solid debris from entering into the fluid passageway 60. In use, pump 10 can be placed on the inside of the hull of a boat so that liquid which may collect in the hull can be removed using pump 10.

Float assembly 28 is coupled to electric motor 20 in a conventional and well known manner. Therefore, the details of such coupling are not presented herein. Float assembly 28 is responsive to the level of liquid surrounding pump 10 so that when the liquid level reaches a certain level, the electric motor 20 is activated or turned on. Although float assembly 28 is illustrated in the drawings, an electric conductivity probe sensor can be used instead to activate the electric motor 20 in response to the level of liquid around pump 10 being at a certain level.

Switch housing 30 together with the housing components noted above, surrounds the float assembly 28 and acts to prevent solid debris from interfering with the operation of the float assembly. Switch housing 30 is secured to the pump housing 12 and connector housing 14 and main motor housing 18. The switch housing 30 includes two spaced apart screw ports 31 (one shown in FIG. 1) which are aligned with two of the fasteners 32 used to join the housing components together. These fasteners are adapted to be received and held in the hollow spaces defined by screw ports 31, thereby joining the switch housing 30 to the housing components.

As shown in FIG. 1, the lower portion of switch housing 30 includes a series of elongated narrow openings 92. These openings are effective in allowing bilge liquid to contact the float assembly 28 so that the float assembly can activate pump 10 when the level of liquid reaches a certain level. The configuration of the switch housing 30, and in particular the lower portion 94 of switch housing 30, is very advantageous. Thus, the lower portion 94 of switch housing 30, which includes the elongated openings 92, is sloped or curved or contoured inwardly toward the pump housing 12. This sloping or contouring of lower switch housing portion 94 has been found to be effective in preventing solid debris in the bilge liquid from sticking to the switch housing 30 and interfering with the action of float assembly 28. Thus, when debris comes in contact with the lower portion 94 of switch housing 30, this debris, because of the inward sloping of lower portion 94, tends to be removed from the openings 92. Thus, the openings 92 are free of debris, and allow liquid to pass therethrough to contact the float assembly 28 so that the pump 10 can be activated when the level of liquid is at a defined level.

Figure 5:
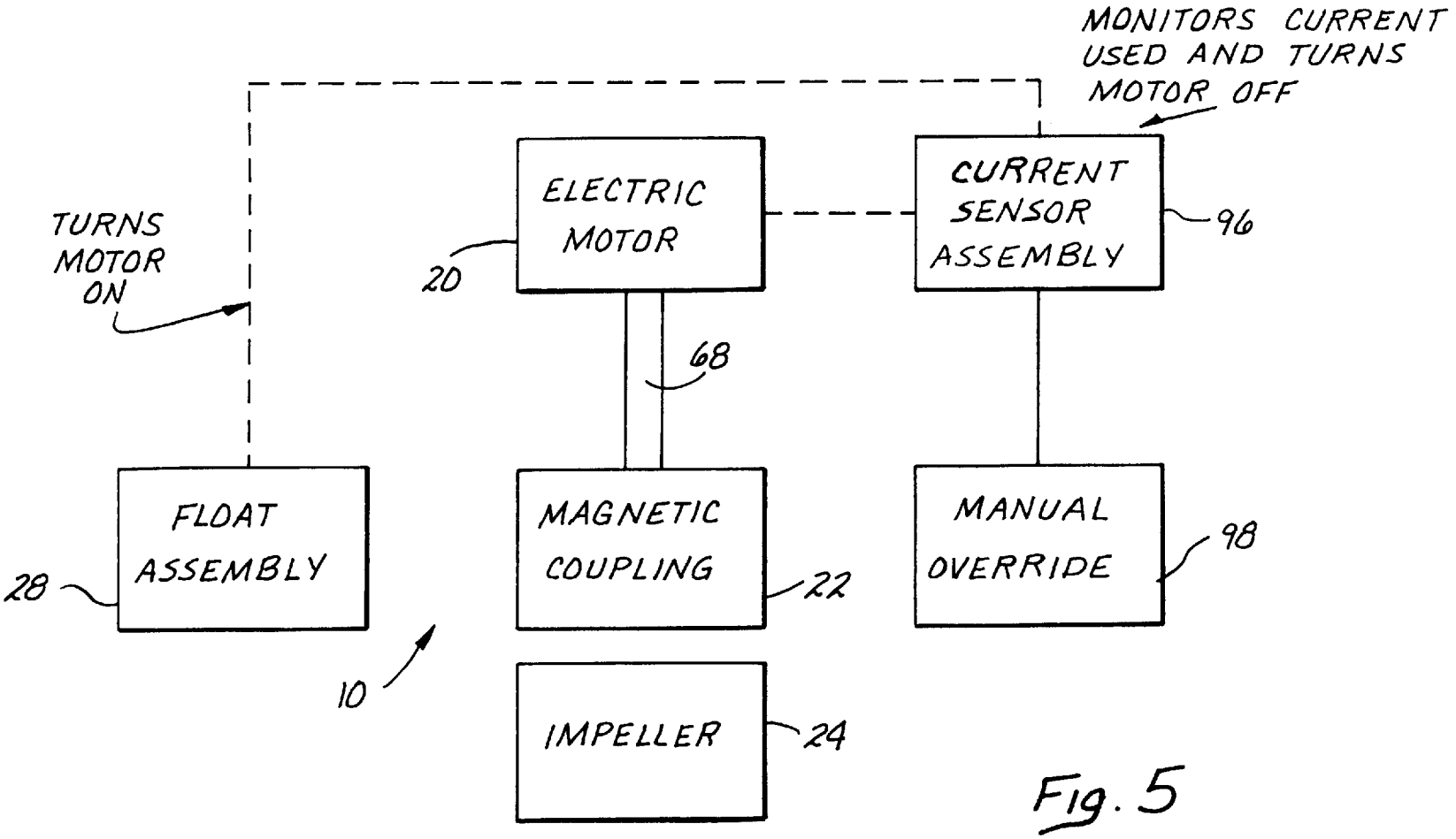
FIG. 5 is a schematic illustration showing one embodiment of the present pump control system.

As shown schematically in FIG. 5, pump 10 includes a current sensor assembly 96 which monitors the current being used by electric motor 20. Current sensor assembly 96 is programmed so that if the amount of current being used by the motor 20 is reduced by a defined amount, the current sensor assembly will turn off the motor. Using the current sensor assembly 96 to turn off electric motor 20 in this manner may be considered to be the "automatic" mode. Thus, with the current sensor assembly 96 operated in the automatic mode, the electric motor 20 turns on when the float assembly 28 indicates that bilge liquid is present. The motor 20 stays on until there is no water at the inlet opening 52 or until the impeller 24, including impeller blades 26, goes into a locked position which makes the magnetic coupling 22 slip, reducing the current used by motor 20. In the event that the float assembly 28 indicates water and the impeller 24 is locked, the circuit will lock the motor 20 off until switched to manual mode or powered down for several minutes and then powered up again.

The current sensor assembly 96 is equipped with a manual override switch 98 which allows motor 20 to be operated continuously whether water is present at inlet opening 52 or the impeller 24 is in a locked position.

Figure 6:
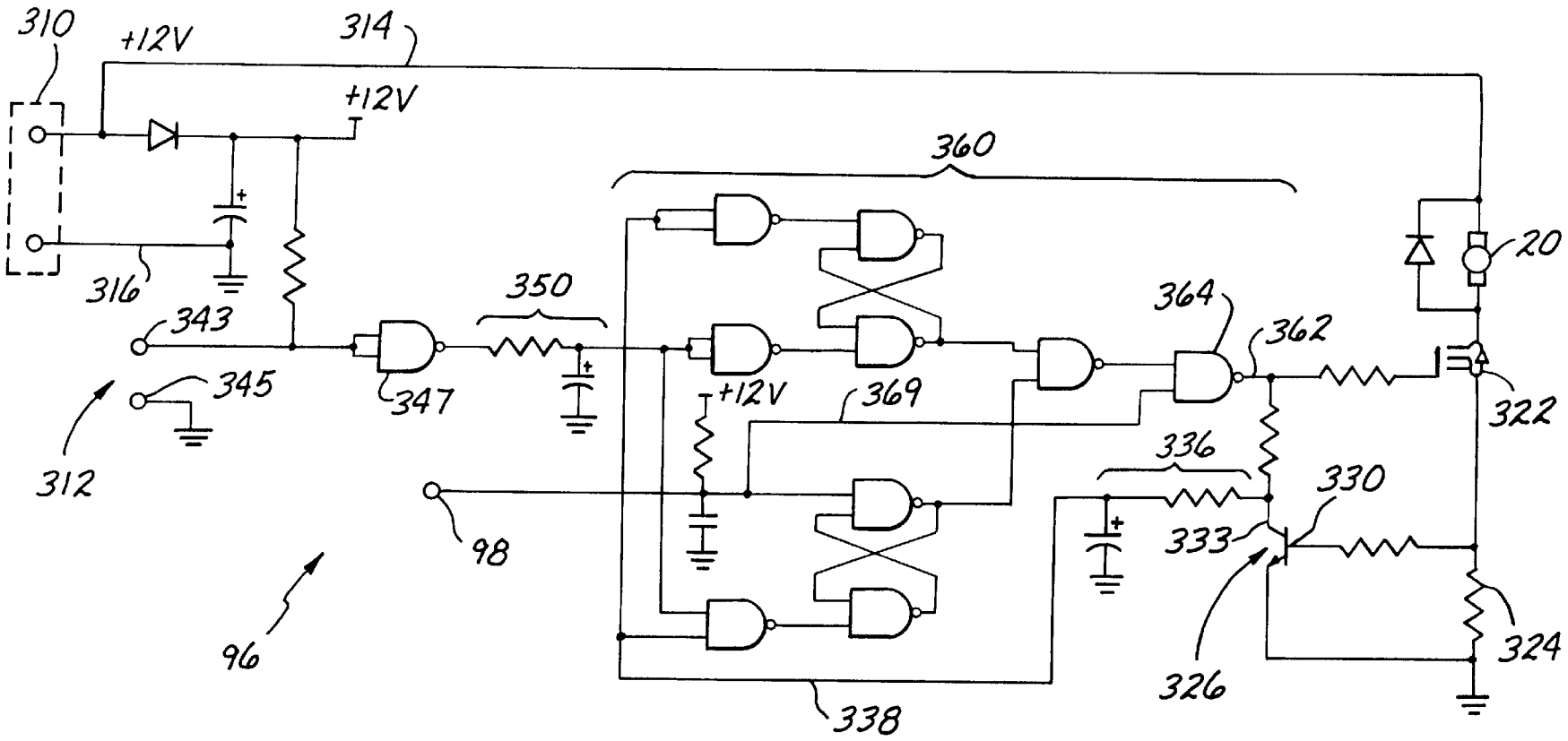
FIG. 6 is a schematic diagram of the current sensing assembly of the pump shown in FIGS. 1, 2 and 3.

FIG. 6 provides an electrical circuit schematic diagram of the circuit sensor assembly 96 and manual override switch 98 described above. The circuit sensor assembly 96 generally comprises a battery 310, a float switch 312 and the manual override switch 98. The battery 310 comprises a positive battery terminal 314 and a negative battery terminal 316. The positive battery terminal 314 is connected to the electric motor 20. Also connected to the electric motor 20 are a MOSFET 322, a current sensing resister 324, and transistor 326.

The current sensing resister 324, as presently embodied, generally operates to sense whether or not the electric motor 20 is being used to pump water. When the electric motor 20 is being used to pump water, a high current passes through the current sensing resister 324. When the electric motor 20 is on but is not being used to pump water, or is in a locked impeller state, a low current passes through the current sensing resistor 324.

When a high current passes through the current sensing resistor 324, a greater voltage drop across the current sensing resister 324 is sensed at the base 330 of the transistor 326 and, consequently, the transistor 326 is turned on. The collector 333 of the transistor 326 is low. If the collector 333 remains low for a period of a few seconds in the presently preferred embodiment, the RC circuit 336 passes this low signal onto the signal line 338. On the other hand, when the current passing through the current sensing transistor 324 is small, corresponding to a no-water or locked impeller state, the collector 333 of the transistor 326 is high. If the voltage on the collector 333 remains high for a few seconds, this signal is passed through the RC circuit 336 and onto the signal line 338. Thus, in summary, the signal line 338 is high in the no-water or locked impeller state, and is low when the electric motor 20 is off or running with a normal water load.

Looking back to the float switch 312, this float switch 312 comprises two terminals 343 and 345. The presence of water moves float 28 so that the two terminals 343 and 345 of float switch 312 are connected together, which corresponds to a high output of the NAND gate 347. This high output of the NAND gate 347 corresponds to a condition where the electric motor 20 should be turned on, as long as the high water state is not transitory. A transitory state may occur, for example, where a wave of water is detected, and the non-transitory level of water is not sufficiently high to justify activation of the electric motor 20. The RC circuit 350 only passes the signal from the NAND gate 347 if this signal remains constant for a few seconds, as presently embodied. If no water is present, the float 28 is positioned so that the two terminals 343 and 345 of the float switch 312 are not connected, and the output of the NAND gate 347 is low.

The NAND gate assembly 360 basically serves to provide a high signal at the output 362 of the NAND gate 364 when the NAND gate 347 output is high and the electric motor 20 should be turned on. When the electric motor 20 should not be turned on and the output of the NAND gate 347 is low, the output 362 of the NAND gate 364 is low.

The manual override switch 98 is connected to ground when activated, and is pulled high when off. When the manual override switch 98 is off, the line 369 is high, to thereby enable the NAND gate 364. When the manual override switch 98 is activated, however, the line 369 goes low to thereby disable the NAND gate 364. That is, when the NAND gate 364 has a zero input from line 369, the output of the NAND gate 364 on line 362 is always high.

It is important that pump 10 in accordance with the present invention is turned off and turned on based on actual process conditions. Thus, float assembly 28 turns motor 20 on when liquid is present to be pumped, and current sensor assembly 96 turns the motor off when no liquid is present or when impeller 24 is in the locked, and inoperable, condition. Prior art systems, such as that described in Anastos et al U.S. Pat. No. 5,324,170, the disclosure of which is hereby incorporated in its entirety by reference herein, monitors the voltage or current used by an electric motor, and turns the pump on at regular time intervals, whether or not liquid is present to be pumped. Such "regular time interval" systems are wasteful of energy since the pump may be turned on for no good reason. The present pumps, in which the pump is turned on only when liquid is present to be pumped, is much more efficient, reduces wear and reduces energy consumption.

Figure 4:
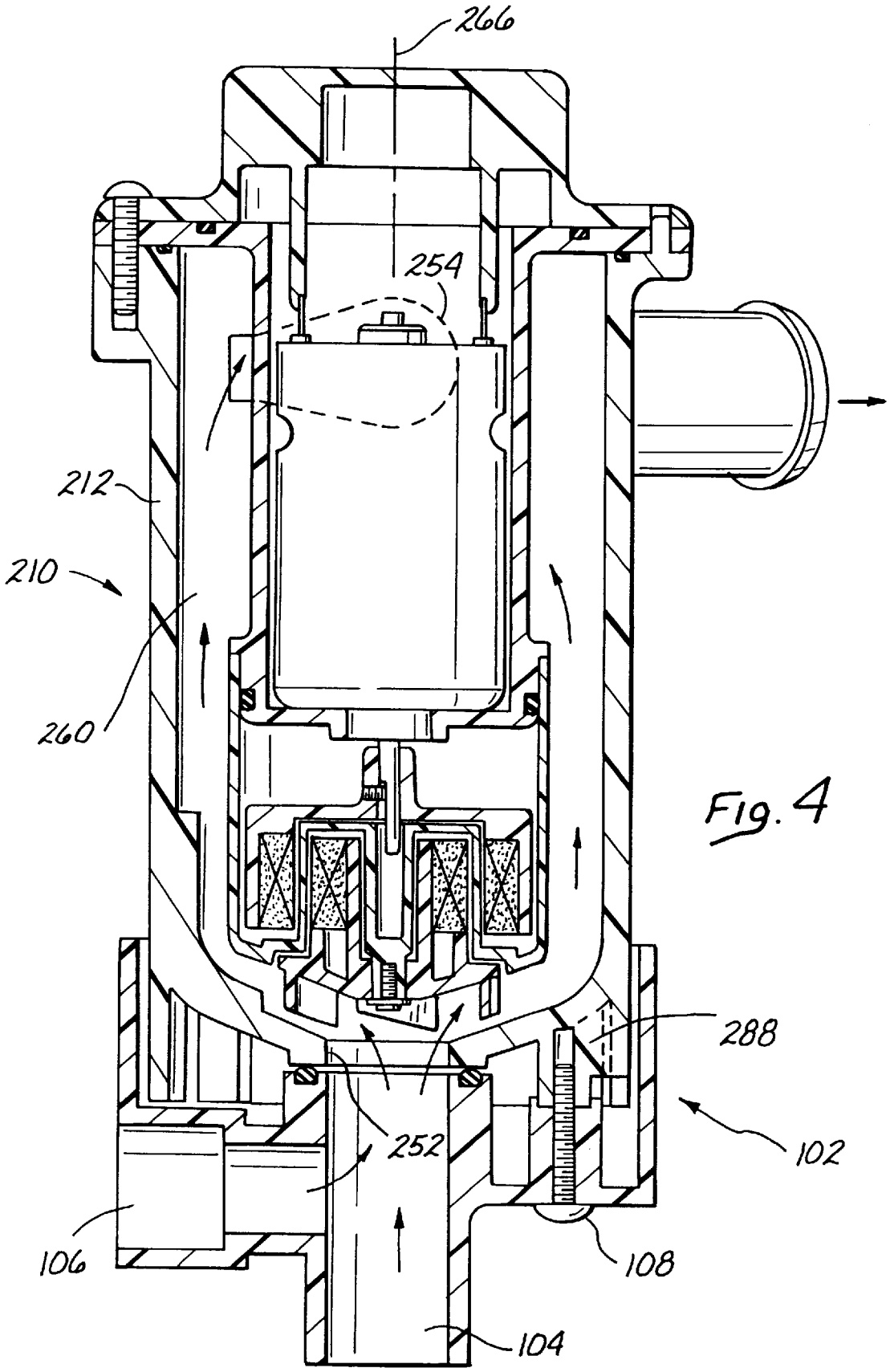
FIG. 4 is a cross-sectional view of an alternate embodiment of a pump in accordance with the present invention.

The pump 210 shown in FIG. 4 is to be used, for example, as a bait tank pump, and includes many of the same features as in pump 10. Except as otherwise expressly stated, pumps 10 and 210 are substantially similarly structured, with components of pump 210 corresponding to components of pump 10 bearing the same reference numeral increased by 200.

The primary differences between pump 10 and pump 210 are that: (1) pump 210 does not include a float assembly, switch housing or current sensing assembly; and (2) pump 210 includes a dual inlet assembly, shown generally at 102.

Dual inlet assembly 102 allows liquid to be passed through inlet opening 252 from a port 104 parallel to the longitudinal axis 266 of pump housing 212. Port 106, which is perpendicular to longitudinal axis 266, is used for the inlet of a washdown pump (not shown) which is used periodically, when needed. Screw type fasteners 108 are used to fasten dual inlet assembly 102 to base 288. The purpose for the inlet port 104 is to allow water from below pump 210 to be pumped. In general, pump 210 will be operated manually, that is as needed, for example, to maintain a bait tank on a boat suitable for live bait. Ocean water is pumped up a distance, for example, about 3 feet, to the bait tank using pump 210. No control system, other than a manual on-off switch, is needed in this embodiment of the pump.

While this invention has been described with respect to various specific examples and embodiments, it is to be understood that the invention is not limited thereto and that it can be variously practiced within the scope of the following claims.

What is claimed is:

1. A pump for pumping liquid comprising:

a pump housing having opposing first and second end regions, a longitudinal axis and a plurality of ribs extending inwardly and located near the first end region, and defining a chamber;

an inlet in said pump housing at said first end region;

an outlet in said pump housing at said second end region;

a motor housing extending into said chamber defined by said pump housing;

a motor located in said motor housing;

an impeller assembly operatively coupled to said motor for pumping liquid which enters said chamber through said inlet; and said pump housing, said motor housing and said impeller assembly together forming a liquid passageway from said inlet to said outlet, said outlet being oriented relative to the liquid passageway so that the liquid being pumped passes through the outlet substantially tangentially relative to the longitudinal axis of the pump housing.

2. The pump of claim 1 wherein said motor housing has a length and said liquid passageway extends along at least a substantial portion of said length of said motor housing within said chamber.

3. The pump of claim 1 wherein said liquid passageway is configured so that liquid in said liquid passageway cools said motor as the liquid moves from said inlet to said outlet.

4. The pump of claim 1 which includes a magnetic coupling adapted to operatively couple said motor to said impeller assembly, and said motor housing includes a first housing section joined to a second housing section, and a seal between said first and second housing sections effective to prevent liquid from passing thereby, said first and second housing sections and said seal being stationary during operation of said pump.

5. The pump of claim 1 wherein said motor housing includes a curved portion of an outer surface and said pump housing includes a curved portion of an inner surface, said curved portions together defining a portion of said liquid passageway and being curved to substantially complement each other.

6. The pump of claim 5 wherein said impeller assembly includes an outer surface and said pump housing includes a curved region of the inner surface, said outer surface and said curved region together defining a portion of said liquid passageway and being curved to substantially complement each other.

7. The pump of claim 1 wherein said motor housing has an outer facing surface with a curved portion and each of said ribs is curved to substantially complement the curved portion of the outer facing surface of the motor housing.

8. The pump of claim 1 which further comprises an activator assembly operatively coupled to said motor, said activator assembly being adapted to activate said motor in response to liquid outside said pump housing being at a defined level.

9. The pump of claim 8 which further comprises a switch housing which, together with said pump housing, surrounds the portion of said activator assembly which comes in contact with liquid, said switch housing including a region having a plurality of elongated through openings to allow liquid from outside said switch housing to come into contact with said portion of said activator assembly, said region being contoured inwardly toward said pump housing to inhibit debris in the liquid outside said switch housing from blocking said elongated through openings.

10. The pump of claim 1 wherein said motor is an electric motor and which further comprises a magnetic coupling adapted to operatively couple said electric motor to said impeller assembly, and a current sensing assembly operatively coupled to said electric motor to sense the amount of electric current used to operate said electric motor and to deactivate said electric motor when the impeller assembly is in a locked and inoperable condition and the amount of electric current used to operate said electric motor is less than a defined current.

11. The pump of claim 1 which further comprises a dual inlet assembly secured to said pump housing, said pump housing having a longitudinal axis, said dual inlet assembly having a first port oriented parallel to the longitudinal axis so that liquid from said first port passes through said inlet, and a second port oriented perpendicular to the longitudinal axis so that liquid from said second port passes through said inlet.

12. A pump comprising:

a pump housing having a curved inner surface and a plurality of ribs extending inwardly;

an inlet in said pump housing;

an outlet in said pump housing spaced apart from said inlet;

a motor housing secured to said pump housing and having a curved outer surface facing said curved inner surface of said pump housing, each of the ribs being curved to substantially compliment said curved outer surface;

a motor located in said motor housing;

an impeller assembly operatively coupled to said motor for pumping liquid which passes through said inlet; and said pump housing, said motor housing and said impeller assembly together forming a liquid passageway from said inlet to said outlet; said curved inner surface and said curved outer surface together forming a portion of said liquid passageway and being curved to substantially complement each other.

13. The pump of claim 12 which includes a magnetic coupling adapted to operatively couple said motor to said impeller assembly, said motor housing includes a first housing section joined to a second housing section, and a seal between said first and second housing sections effective to prevent liquid from passing thereby, said first and second housing sections and said seal being stationary during operation of said pump.

14. The pump of claim 12 wherein said impeller assembly includes an outer surface and said pump housing includes a curved region of the inner surface, said outer surface and said curved region together defining a portion of said liquid passageway and being curved to substantially complement each other.

15. The pump of claim 12 which further comprises an activator assembly operatively coupled to said motor, said activator assembly being adapted to activate said motor in response to liquid outside said pump housing being at a defined level, and a switch housing which, together with said pump housing, surrounds the portion of said activator assembly which comes in contact with liquid, said switch housing including a region having a plurality of elongated through openings to allow liquid from outside said switch housing to come into contact with said portion of said activator assembly, said region being contoured inwardly toward said pump housing to inhibit debris in the liquid outside said switch housing for blocking said elongated through openings.

16. The pump of claim 15 wherein said motor is an electric motor and which further comprises a current sensing assembly operatively coupled to said electric motor to sense the amount of electric current used to operate said electric motor and to deactivate said electric motor when the amount of electric current used to operate said electric motor is less than a defined current.

17. The pump of claim 12 wherein said motor is an electric motor and which further comprises a magnetic coupling adapted to operatively couple said electric motor to said impeller assembly, and a current sensing assembly operatively coupled to said electric motor to sense the amount of electric current used to operate said electric motor and to deactivate said electric motor when the impeller assembly is in a locked and inoperable condition and the amount of electric current used to operate said electric motor is less than a defined current.

18. A pump comprising:

a pump housing;

an inlet in said pump housing;

an outlet in said pump housing spaced apart from said inlet;

a motor;

an impeller assembly operatively coupled to said motor for pumping liquid which passes through said inlet;

an activator assembly operatively coupled to said motor, said activator assembly being adapted to activate said motor in response to liquid being at a defined level; and a switch housing which, together with said pump housing, surrounds the portion of said activator assembly which comes in contact with liquid, said switch housing including a region having a plurality of elongated through openings to allow liquid from outside said switch housing to come into contact with said portion of said activator assembly, said region being contoured inwardly toward said pump housing to inhibit debris in the liquid outside said switch housing for blocking said elongated through openings.

19. The pump of claim 18 where said motor is an electric motor and which further comprises a current sensing assembly operatively coupled to said electric motor to sense the amount of electric current used to operate said electric motor and to deactivate said electric motor when the amount of electric current used to operate said electric motor is less than a defined current.

20. A pump comprising:

a pump housing;

an inlet in said pump housing;

an outlet in said pump housing spaced apart from said inlet;

an electric motor;

an impeller assembly operatively coupled to said electric motor for pumping liquid which enters the chamber through said inlet;

a magnetic coupling adapted to operatively couple said electric motor to said impeller assembly;

an activator assembly operatively coupled to said electric motor, said activator assembly being adapted to activate said electric motor in response to liquid outside said pump housing being at a defined level; and a current sensing assembly operatively coupled to said electric motor to sense the amount of electric current used to operate said electric motor and to deactivate said electric motor when the impeller assembly is in a locked and inoperable condition and the amount of electric current used to operate said electric motor is less than a defined amount.

21. The pump of claim 20 wherein said motor housing includes a first housing section joined to a second housing section, and a seal between first and second housing sections effective to prevent liquid from passing thereby, said first and second housing sections and said seal being stationery during operation of said pump.

* * * * *